US007187292B2

(12) United States Patent
Hayashi et al.

(10) Patent No.: US 7,187,292 B2
(45) Date of Patent: Mar. 6, 2007

(54) PHYSICAL CONDITION MONITORING SYSTEM

(75) Inventors: Masaki Hayashi, Aichi (JP); Yukio Iwasaki, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 84 days.

(21) Appl. No.: 10/889,792

(22) Filed: Jul. 13, 2004

(65) Prior Publication Data

US 2005/0012625 A1 Jan. 20, 2005

(30) Foreign Application Priority Data

Jul. 18, 2003 (JP) ..... 2003-276563

(51) Int. Cl.
*G08B 23/00* (2006.01)

(52) U.S. Cl. ..... 340/576; 340/439; 340/539.12; 600/300

(58) Field of Classification Search ..... 340/575, 340/576, 5.31, 5.72, 539.12; 128/671, 668; 600/300
See application file for complete search history.

(56) References Cited

U.S. PATENT DOCUMENTS 5,195,606 A * 3/1993 Martyniuk ..... 180/272
5,335,664 A * 8/1994 Nagashima ..... 600/508
5,917,415 A * 6/1999 Atlas ..... 340/575
5,942,979 A * 8/1999 Luppino ..... 340/576
6,239,707 B1 * 5/2001 Park ..... 340/576
6,351,698 B1 * 2/2002 Kubota et al. ..... 701/51
6,428,475 B1 * 8/2002 Shen ..... 600/300
6,771,161 B1 * 8/2004 Doi et al. ..... 340/5.64
6,791,462 B2 * 9/2004 Choi ..... 340/575
6,958,675 B2 * 10/2005 Maeda et al. ..... 340/5.61
2002/0030585 A1 * 3/2002 Doi et al. ..... 340/5.64
2004/0021500 A1 * 2/2004 Nakano ..... 327/534

FOREIGN PATENT DOCUMENTS

JP 2000-016181 1/2000
JP 2003-104126 4/2003

* cited by examiner

*Primary Examiner*—Jeffery Hofsass
*Assistant Examiner*—Hoi C. Lau
(74) *Attorney, Agent, or Firm*—Patterson, Thuente, Skaar & Christensen, P.A.

(57) ABSTRACT

A system that directly monitors a physical condition of a driver. The system includes a portable device carried by the driver. The portable device includes a perspiration sensor, for detecting biological information serving as an index representing the physical condition of the driver, and a transmitter circuit, for generating a transmission signal including the biological information detected by the perspiration sensor. The monitoring device, which is installed in the vehicle, includes a receiver circuit for receiving the transmission signal from the portable device. A microcomputer and a display inform the driver of his or her physical condition based on the transmission signal received by the receiver circuit.

18 Claims, 2 Drawing Sheets

PHYSICAL CONDITION MONITORING SYSTEM

BACKGROUND OF THE INVENTION

The present invention relates to a system for monitoring a physical condition, and more specifically, to a system for monitoring the physical condition of a driver of a vehicle.

Recently, a vehicle provided with an on-vehicle camera for detecting a driver dozing off has been proposed.

Japanese Laid-Open Patent Publication No. 2003-104126 describes a vehicle passenger compartment monitoring apparatus, which includes a camera attached to a rearview mirror (vehicle interior). The camera generates an image of the passenger compartment, and a computer analyzes the generated image. The vehicle passenger compartment monitoring apparatus detects the driver dozing off based on the analyzed result.

Japanese Laid-Open Patent Publication No. 2000-016181 describes a vehicle periphery recognition system, which includes a CCD camera arranged on a rearview mirror attached to a door (vehicle exterior). The CCD camera generates an image of a traffic lane. If the vehicle changes traffic lanes when a turn indicator lever is not operated, the vehicle periphery recognition system determines that the driver has dozed off.

However, the above apparatus and system only indirectly detects a driver dozing off using an imaging means, such as the CCD camera.

SUMMARY OF THE INVENTION

The present invention provides a system capable of directly monitoring the physical condition of a driver.

One aspect of the present invention is a system for monitoring a physical condition of a driver for a vehicle. The system includes a portable device carried by the driver. The portable device includes a detection unit, for detecting biological information serving as an index representing the physical condition of the driver, and a transmitter unit, for transmitting a transmission signal including the biological information detected by the detection unit. A monitoring device is installed in the vehicle. The monitoring device includes a receiver unit, for receiving the transmission signal from the portable device, and a notification unit, for notifying the driver of his or her physical condition based on the biological information included in the transmission signal received by the receiver unit.

Another aspect of the present invention is a system for monitoring a physical condition of a driver for a vehicle that includes a controlled subject. The system includes a portable device carried by the driver. The portable device includes a detection unit, for detecting biological information serving as an index representing the physical condition of the driver, and a transmitter unit, for transmitting a transmission signal including the biological information detected by the detection unit. A monitoring device is installed in the vehicle. The monitoring device includes a receiver unit, for receiving the transmission signal from the portable device, and a control unit, for selectively enabling the operation of the controlled subject of the vehicle in accordance with the physical condition of the driver based on the biological information included in the transmission signal received by the receiver unit.

A further aspect of the present invention is a system for monitoring a physical condition of a driver for a vehicle. The system includes a portable device carried by the driver. The portable device includes a detection unit, for detecting biological information serving as an index representing the physical condition of the driver when contacting the driver, a first electrode that contacts the driver, and a transmitter unit connected to the first electrode for transmitting a transmission signal including the biological information detected by the detection unit via the first electrode. A monitoring device is installed in the vehicle. The monitoring device includes an operation unit, operated by the driver and having a second electrode that contacts the driver, a receiver unit, connected to the second electrode, for receiving the transmission signal from the portable device via the second electrode, a control unit for receiving the transmission signal from the receiver unit and determining the physical condition of the driver based on the biological information included in the transmission signal, and a notification unit for providing notification of the physical condition determined by the control unit.

A further aspect of the present invention is a portable device carried by a driver for a vehicle. The portable device includes a detection unit for detecting biological information serving as an index representing a physical condition of the driver. A transmitter unit transmits a transmission signal including the biological information detected by the detection unit to the vehicle.

A further aspect of the present invention is a method for monitoring a physical condition of a driver for a vehicle. The driver carries a portable device including a detection unit for acquiring biological information of the driver, and the vehicle includes a monitoring device. The method includes acquiring the biological information of the driver with the detection unit of the portable device, transmitting a transmission signal including the biological information of the driver from the portable device to the monitoring device, and notifying the driver of his or her physical condition with the monitoring device based on the biological information included in the transmission signal.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A physical condition monitoring system 1 according to a preferred embodiment of the present invention will now be described.

Figure 1:
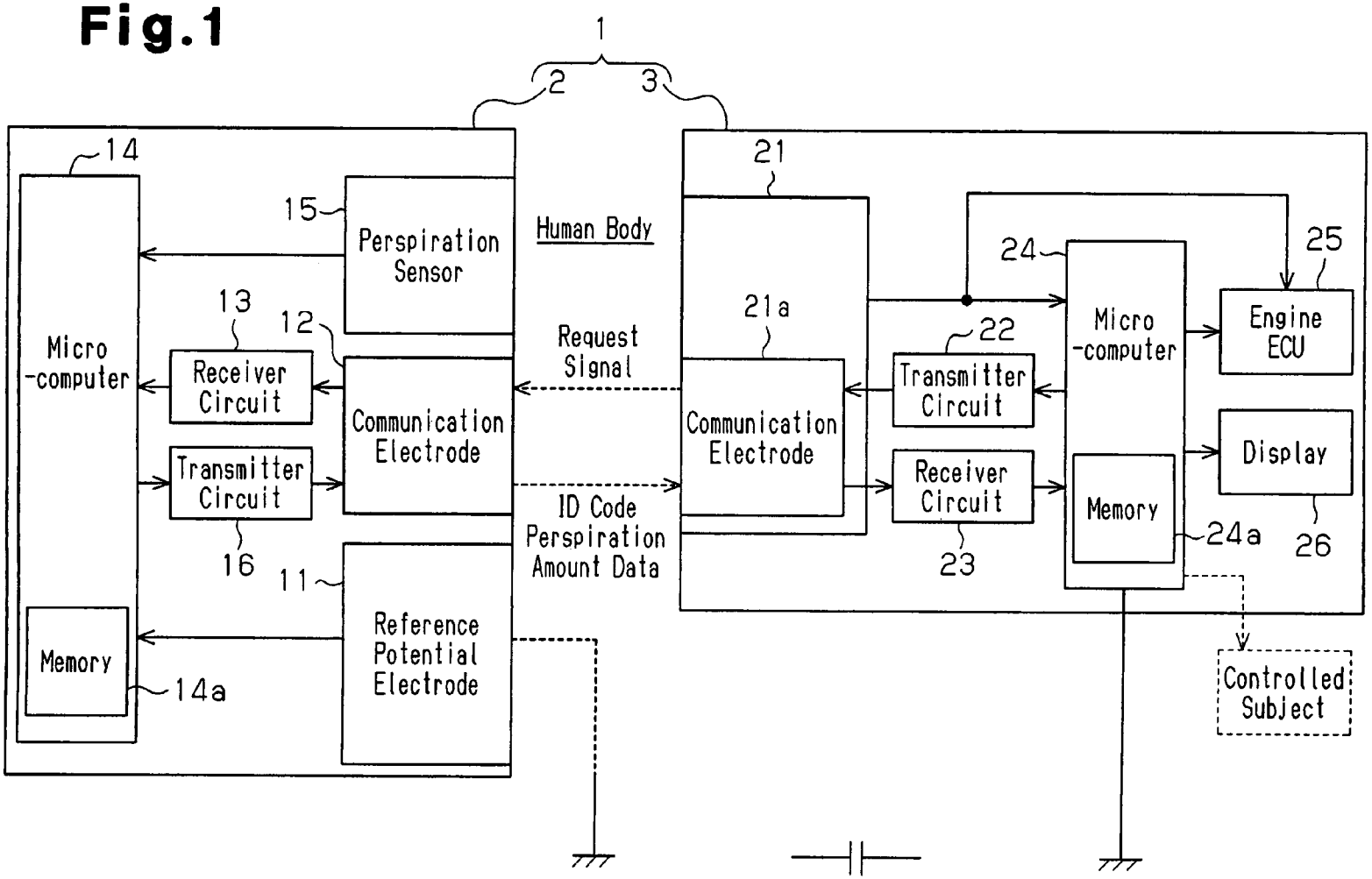
FIG. 1 is a schematic block diagram showing a physical condition monitoring system according to a preferred embodiment of the present invention.

As shown in FIG. 1, the physical condition monitoring system 1 includes a portable device 2 and a vehicle monitoring device 3. The portable device 2 is carried by the driver. The portable device 2 of the preferred embodiment is configured in the form of a wrist watch. The driver wears the portable device 2 by wrapping it around his or her arm.

When the driver wears the portable device 2 in this manner, the rear surface of the portable device 2 comes into close contact with the driver's arm. The vehicle monitoring device 3 is installed in an automobile and includes an engine start switch 21. The physical condition monitoring system 1 is configured to enable two-way communication between the portable device 2 and the vehicle monitoring device 3. In the physical condition monitoring system 1 of the preferred embodiment, when the driver wearing the portable device 2 operates the engine start switch 21, the portable device 2 and the vehicle monitoring device 3 communicate with each other through the body of the driver (bodily communication).

The portable device 2 is provided with a receiving function and a transmitting function. The portable device 2 includes a reference potential electrode 11, a communication electrode 12, a receiver circuit 13, a microcomputer 14, a perspiration sensor 15, and a transmitter circuit 16. The reference potential electrode 11 is exposed from the rear surface of the portable device 2. The reference potential electrode 11 is grounded through the body of the driver when the portable device 2 is worn on the arm of the driver as described above. In the same manner as the reference potential electrode 11, the communication electrode 12 is exposed from the rear surface of the portable device 2.

The vehicle monitoring device 3 transmits a request signal. The receiver circuit 13 receives the request signal transmitted from the vehicle monitoring device 3. When the driver wearing the portable device 2 operates the engine start switch 21, the receiver circuit 13 of the preferred embodiment receives the request signal from the vehicle monitoring device 3 via the body of the driver and the communication electrode 12. After receiving the request signal, the receiver circuit 13 generates a receiver signal from the request signal and provides the receiver signal to the microcomputer 14. The microcomputer 14 includes a memory 14*a* in addition to a CPU, a ROM, and a RAM (not shown). The memory 14*a* stores an ID code unique to the portable device 2 (ID code differs for each portable device).

The perspiration sensor 15 is electrically connected to the microcomputer 14. The perspiration sensor 15 is exposed from the rear surface of the portable device 2. The perspiration sensor 15, for example, includes a pair of electrodes (not shown) that contact the driver. The perspiration sensor 15 applies a predetermined voltage between the pair of electrodes to measure the impedance between the electrodes (i.e., impedance of the body surface of the driver). Based on the measured impedance, the relevant perspiration sensor 15 detects the perspiration amount of the driver and provides a detection signal indicating the relevant perspiration amount to the microcomputer 14. After receiving the receiver signal from the receiver circuit 13, the microcomputer 14 generates a response signal for the request signal. More specifically, the microcomputer 14 generates a response signal for the request signal based on the ID code, which is stored in the memory 14*a*, and the latest detection signal, which has already been received from the perspiration sensor 15 when the microcomputer 14 received the receiver signal.

The microcomputer 14 provides the transmitter circuit 16 with a signal including the ID code of the portable device 2 and perspiration amount data, which indicates the perspiration amount, as the response signal for the request signal. When the driver wearing the portable device 2 operates the engine start switch 21, the transmitter circuit 16 of the preferred embodiment transmits the response signal via the communication electrode 12 and the body of the driver.

In addition to the engine start switch 21, the vehicle monitoring device 3 includes a transmitter circuit 22, a receiver circuit 23, a microcomputer 24, an engine ECU 25, and a display 26. The engine start switch 21 is operated by the driver to start the engine. That is, the engine start switch 21 is operated by the driver before driving the vehicle. A communication electrode 21*a* is exposed from the front surface of the engine start switch 21. When the driver wearing the portable device 2 operates the engine start switch 21, the request signal is provided from the microcomputer 24 to the transmitter circuit 22, and the transmitter circuit 22 transmits the request signal to the portable device 2 via the communication electrode 21*a* and the body of the driver.

The receiver circuit 23 receives the response signal transmitted from the portable device 2, more specifically, the signal including the ID code of the portable device 2 and the perspiration amount data, which indicates the perspiration amount of the driver. When the driver wearing the portable device 2 operates the engine start switch 21, the receiver circuit 23 of the preferred embodiment receives the response signal from the portable device 2 via the body of the driver and the communication electrode 21*a*. After receiving the response signal from the portable device 2, the receiver circuit 23 generates a receiver signal from the response signal and provides the receiver signal to the microcomputer 24. The receiver signal provided from the receiver circuit 23 to the microcomputer 24 includes the ID code of the portable device 2 and the perspiration amount data, which indicates the perspiration amount of the driver.

The microcomputer 24 includes a memory 24*a* in addition to a CPU, a ROM, and a RAM (not shown). The memory 24*a* stores an ID code (ID code of a vehicle) that is the same as the ID code of the authentic portable device 2. Further, the memory 24*a* stores the data indicating a threshold value of the perspiration amount.

The microcomputer 24 provides the request signal to the transmitter circuit 22 to establish two-way communication between the portable device 2 and the vehicle monitoring device 3. The microcomputer 24 of the preferred embodiment provides the request signal to the transmitter circuit 22 when the driver wearing the portable device 2 operates the engine start switch 21. Thereafter, the microcomputer 24 receives the response signal for the request signal from the portable device 2 via the receiver circuit 23 and determines whether the ID code of the portable device 2 included in the response signal matches the ID code of the vehicle stored in the memory 24*a* (ID code verification). Further, the microcomputer 24 determines whether the perspiration amount of the driver indicated by the perspiration amount data included in the response signal exceeds the threshold value of the perspiration amount in the data stored in the memory 24*a* (determination of driver's fatigue level).

The microcomputer 24 outputs an engine start enabling signal to the engine ECU 25 when the two ID codes match during the ID code verification. The engine ECU 25 starts the engine by driving a starter motor (not shown) when the engine start switch 21 is operated while the engine start enabling signal is being provided from the microcomputer 24.

The microcomputer 24 provides a warning display command signal to the display 26 when the perspiration amount of the driver exceeds the perspiration amount threshold value during the fatigue determination. In response to the warning display command signal of the microcomputer 24, the display 26 displays a message suggesting that the driver is slightly fatigued. In the preferred embodiment, the display 26 displays a relevant message "perspiration amount is relatively high" on a screen.

Figure 2:
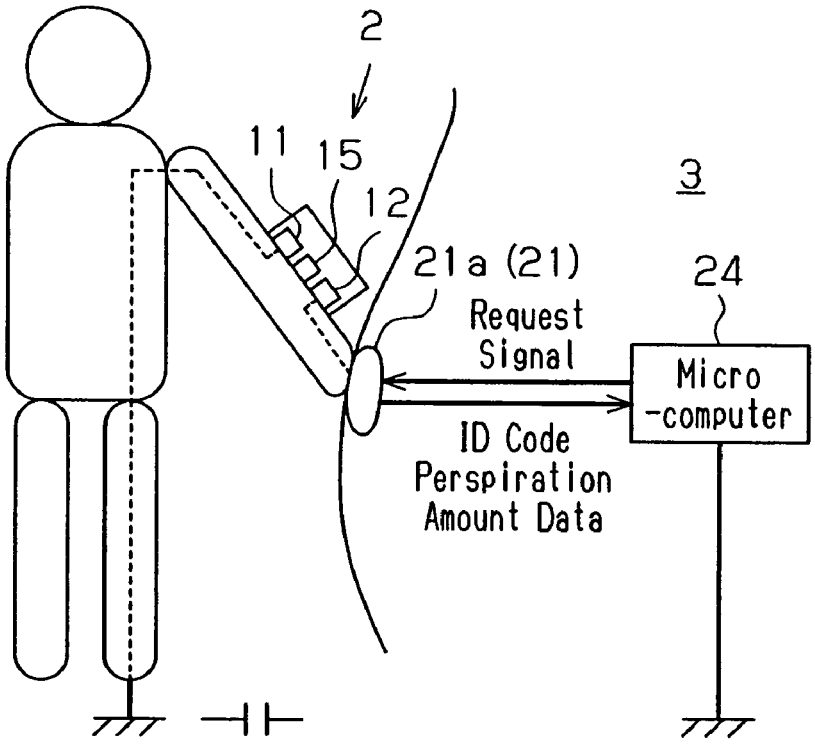
FIG. 2 is a schematic view of bodily communication performed by the physical condition monitoring system of FIG. 1.

The operation of the physical condition monitoring system 1 will now be described with reference to FIGS. 1 and 2.

When the driver wearing the portable device 2 operates the engine start switch 21, the vehicle monitoring device 3 transmits the request signal via the body of the driver. When the portable device 2 receives the request signal, the portable device 2 transmits the response signal via the body of the driver. The response signal includes the ID code of the portable device 2 and the perspiration amount data, which indicates the perspiration amount of the driver.

When receiving the response signal, the vehicle monitoring device 3 performs the ID code verification. If the ID code of the portable device 2 matches the ID code of the vehicle, the vehicle monitoring device 3 allows the engine to start. The vehicle monitoring device 3 then performs the fatigue determination subsequent to the ID code verification. If the perspiration amount of the driver exceeds the threshold value of the perspiration amount stored in the memory 24*a*, the display 26 displays a message suggesting that the driver is slightly fatigued.

The physical condition monitoring system 1 of the preferred embodiment of the present invention has the following advantages.

(1) The perspiration sensor 15 of the portable device 2 detects the perspiration amount of the driver as biological information, which serves as an index representing the physical condition of the driver. The response signal including the perspiration amount data, which indicates the perspiration amount of the driver detected by the perspiration sensor 15, is then transmitted by the transmitter circuit 16 of the portable device 2. The receiver circuit 23 of the vehicle monitoring device 3 receives the response signal from the portable device 2. The microcomputer 24 determines the physical condition of the driver based on the response signal and the display 26 shows the determination result of the physical condition. In other words, the perspiration sensor 15 of the portable device 2 directly detects the biological information, which serves as an index representing the physical condition of the driver, and the display 26 of the vehicle monitoring device 3 shows the physical condition of the driver based on the relevant biological information. In this manner, the physical condition monitoring system 1 directly monitors the physical condition of the driver.

(2) When the driver operates the engine start switch 21 of the vehicle monitoring device 3, the bodily communication transmits the response signal, which includes the data indicating the biological information, from the transmitter circuit 16 of the portable device 2 via the body of the driver. That is, when the driver performs the operation necessary to start the engine, the biological information of the driver is transmitted. Therefore, the physical condition monitoring system 1 does not force the driver to perform any kind of special operation and thus does not confuse the driver. Accordingly, the physical condition monitoring system 1 has a high level of operability and is convenient.

(3) When the driver operates the engine start switch 21, the display 26 of the vehicle monitoring device 3 shows the physical condition of the driver prior to driving the vehicle. This may enable a situation in which the driver starts driving in a slightly fatigued state to be avoided.

(4) The message suggesting that the driver is slightly fatigued is shown on the display 26 only if the perspiration amount of the driver exceeds the threshold value of the perspiration amount stored in the memory 24*a*. This minimizes the frequency of the fatigue warning message being shown on the display 26. Therefore, the message is not frequently displayed on the display 26 and a situation in which the driver is distracted by the frequent display of the message is avoided.

(5) The portable device 2 is in the forms of a wristwatch, and the reference potential electrode 11 and the communication electrode 12 are exposed from the rear surface of the portable device 2. In this configuration, when the portable device 2 is worn around the arm of the driver, the reference potential electrode 11 and the communication electrode 12 closely contact the arm of the driver. Therefore, the portable device 2 and the vehicle monitoring device 3 perform the bodily communication in an optimal manner via the body of the driver.

(6) The perspiration sensor 15 is exposed from the rear surface of the portable device 2. In this configuration, when the portable device 2 is worn around the arm of the driver, the perspiration sensor 15 closely contacts the arm of the driver. Therefore, the perspiration sensor 15 acquires the biological information (the perspiration amount of the driver in the preferred embodiment), which serves as an index representing the physical condition of the driver, in an optimal manner.

(7) In view of the above advantages (5) and (6), it may be concluded that the portable device 2 is configured in an optimal manner as the physical condition monitoring system 1 capable of directly monitoring the physical condition of the driver.

It should be apparent to those skilled in the art that the present invention may be embodied in many other specific forms without departing from the spirit or scope of the invention. Particularly, it should be understood that the present invention may be embodied in the following forms.

The physical condition monitoring system 1 may be configured so that the threshold value data of the perspiration amount is rewritable by the driver or the automobile dealer. The perspiration amount level used to inform (or notify) that the driver is slightly fatigued may be set differently for each individual driver. This would enable the physical condition monitoring system 1 to directly monitor the physical condition of the driver based on the perspiration amount level that is appropriate to the driver.

In the preferred embodiment, the physical condition monitoring system 1 gives off a fatigue warning only when the perspiration amount of the driver exceeds the threshold value of the perspiration amount. However, the physical condition monitoring system 1 may display information regarding the physical condition of the driver before driving regardless of the amount of the perspiration.

In the preferred embodiment, smart communication for transmitting and receiving the request signal and the signal including the ID code and physical condition communication for transmitting and receiving a signal including data indicating the biological information are both performed through bodily communication. However, wireless communication may be performed for smart communication and bodily communication may be performed only for the physical condition communication. In this case, when the driver wearing the portable device 2 gets on the vehicle, the request signal and the signal including the ID code are transmitted and received by wireless communication. Further, when the driver wearing the portable device 2 operates the engine start switch 21, the signal including data indicative of the biological information of the driver is transmitted and received through bodily communication.

Smart communication and physical condition communication may both be performed through wireless communication.

Alternatively, smart communication may be performed through bodily communication and physical condition communication may be performed through wireless communication.

In the preferred embodiment, the vehicle monitoring device 3 includes the communication electrode 21*a* that is exposed from the front surface of the engine start switch 21. However, the vehicle monitoring device 3 may include a communication electrode that is exposed from the front surface of a shift lever, which is operated before driving, such as the engine start switch 21.

The vehicle monitoring device 3 may include communication electrodes exposed from the front surfaces of a plurality of operation units operated before driving.

The vehicle monitoring device 3 may include a communication electrode exposed from the front surface of an operation unit that is operated when driving the vehicle (e.g., steering wheel) in lieu of or in addition to the communication electrode exposed from the front surface of the operation unit that is operated before driving the vehicle. In such a configuration, the driver is informed of his or her physical condition when driving the vehicle. Thus, a situation in which the driver continues driving in a slightly fatigued state may be avoided.

The driver may be audibly informed of his or her physical condition in lieu of or in addition to visual information on the display.

The vehicle monitoring device 3 may include a communication electrode exposed from the front surface of an operation unit operated before the driver gets into the vehicle (e.g., door handle). In such a configuration, the driver is informed of his or her physical condition before the driver gets into the vehicle. Thus, a situation in which the driver gets into the vehicle in a slightly fatigued state is avoided.

The vehicle monitoring device 3 may include a communication electrode exposed from the front surface of at least one of such operation units that are operated prior to entry of the vehicle, before driving the vehicle, or when driving the vehicle.

The portable device 2 does not have to have the form of a wristwatch, and may be in the form of, for example, a bracelet, eyeglasses, or a ring. In other words, the portable device 2 may be in any form as long as it contacts the body of the driver. However, it is preferred that the portable device 2 closely contacts the driver, and further preferred that the portable device 2 be normally worn on the body of the driver regardless of whether or not the driver gets into the vehicle.

The detection unit for detecting the biological information that serves as an index representing the physical condition of the driver is not limited to the perspiration sensor 15, and may be, for example, a heartbeat (pulse) sensor for detecting the heartbeat (pulse), a blood pressure sensor for detecting the blood pressure, or a body temperature sensor for detecting the body temperature. That is, the portable device 2 may include a heartbeat (pulse) sensor, a blood pressure sensor, or a body temperature sensor in place of or in addition to the perspiration sensor 15. The biological information serving as the index representing the physical condition of the driver is directly detected by the above mentioned detection unit. The physical condition monitoring system 1 then informs the driver of his or her physical condition based on the relevant biological information. The physical condition monitoring system 1 may provide a doze warning in lieu of or in addition to the fatigue warning.

In the preferred embodiment, if the perspiration amount of the driver exceeds the threshold value of the perspiration amount, the physical condition monitoring system 1 provides the fatigue warning. In such a case, the physical condition monitoring system 1 may disable the starting of the engine in lieu of or in addition to providing the fatigue warning. That is, even if the two ID codes match during the ID code verification, if the perspiration amount of the driver exceeds the threshold value of the perspiration amount, the microcomputer 24 disables the starting of the engine. In such a configuration, if the two ID codes match in the ID code verification and if the perspiration amount of the driver is less than or equal to the threshold value of the perspiration amount, the microcomputer 24 enables starting of the engine.

If the perspiration amount of the driver exceeds the threshold value of the perspiration amount, the microcomputer 24 may disable the unlocking of a door (including a trunk door), the shift lever, or the steering wheel.

If the perspiration amount data indicating the perspiration amount of the driver exceeds the threshold value of the perspiration amount, the microcomputer 24 may enable the unlocking of a door but disable unlocking of the steering wheel, starting of the engine, or unlocking of the shift lever. Alternatively, if the perspiration amount of the driver exceeds the threshold value of the perspiration amount, the microcomputer 24 may enable unlocking of the trunk door but disable unlocking of other doors (doors opened and closed to enter the vehicle, such as the driver's door, the passenger's door, and rear seat doors)

The memory 24*a* may store data including a plurality of threshold values of the perspiration amount. The memory 24*a* may store, for example, data including a first threshold value and a second threshold value greater than the first threshold value. If the perspiration amount of the driver is less than or equal to the first threshold value, the microcomputer 24 enables unlocking of the door, unlocking of the steering wheel, starting of the engine, and unlocking of the shift lever. If the perspiration amount of the driver exceeds the first threshold value but is less than or equal to the second threshold value, the microcomputer 24 enables unlocking of the door but disables unlocking of the steering wheel, starting of the engine, and unlocking of the shift lever. If the perspiration amount of the driver exceeds the second threshold value, the microcomputer 24 disables unlocking of the door, unlocking of the steering wheel, starting of the engine, and unlocking of the shift lever. In this manner, the physical condition monitoring system 1 may enable or disable the operation of a subject that is controlled, such as the engine, in accordance with the physical condition of the driver.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

What is claimed is:

1. A system for monitoring a physical condition of a driver for a vehicle including an engine, a door, a shift lever, and a steering wheel, the system comprising:

a portable device carried by the driver, the portable device including a detection unit, for detecting biological information comprising at least one of perspiration amount and body temperature and serving as an index representing the physical condition of the driver, and a transmitter unit, for transmitting a transmission signal including the biological information comprising at least one of perspiration amount and body temperature detected by the detection unit; and a monitoring device installed in the vehicle, the monitoring device including a receiver unit, for receiving the transmission signal from the portable device, and a notification unit, for notifying the driver of his or her physical condition based on the biological information comprising at least one of perspiration amount and body temperature and included in the transmission signal received by the receiver unit, wherein the monitoring device enables the unlocking of the door and disable unlocking of the steering wheel, starting of the engine, or unlocking of the shift lever if the perspiration amount of the driver exceeds a threshold value.

2. The system as claimed in claim 1, wherein the notification unit notifies the driver of his or her physical condition when a numerical value related to the biological information comprising at least one of perspiration amount or body temperature and exceeds a predetermined threshold value.

3. The system as claimed in claim 2, wherein the vehicle has a vehicle ID code, the transmission signal includes a portable device ID code, and the vehicle enables starting of the engine when the portable device ID code corresponds to the vehicle ID code.

4. The system as claimed in claim 1, wherein the biological information is comprises heartbeat or blood pressure and at least one of perspiration amount and body temperature.

5. The vehicle system as claimed in claim 1, wherein:

the vehicle includes an operation unit operated by the driver and connected to the monitoring device; and the portable device is configured so as to transmit the transmission signal including the biological information comprising at least one of perspiration amount and body temperature to the monitoring device via the body of the driver when the driver operates the operation unit.

6. The system as claimed claim 5, wherein the operation unit is operated by the driver when driving the vehicle.

7. The system as claimed in claim 5, wherein the operation unit is operated by the driver before driving the vehicle.

8. The system as claimed in claim 5, wherein the portable device includes a first electrode that contacts the driver and is connected to the transmitter unit, and the operation unit includes a second electrode that contacts the driver and is connected to the receiver unit.

9. The system as claimed in claim 8, wherein the portable device has a wristwatch form, and the first electrode is arranged on a rear surface of the portable device so as to closely contact the driver.

10. A system for monitoring a physical condition of a driver for a vehicle that includes controlled subjects including an engine, a door, a shift lever, and a steering wheel, the system comprising:

a portable device carried by the driver, the portable device including a detection unit, for detecting biological information comprising at least one of perspiration amount and body temperature and serving as an index representing the physical condition of the driver, and a transmitter unit, for transmitting a transmission signal including the biological information comprising at least one of perspiration amount and body temperature and detected by the detection unit; and a monitoring device installed in the vehicle, the monitoring device including a receiver unit, for receiving the transmission signal from the portable device, and a control unit, for selectively enabling the operation of the controlled subject of the vehicle in accordance with the physical condition of the driver based on the biological information comprising at least one of perspiration amount and body temperature and included in the transmission signal received by the receiver unit, wherein the control unit enables the unlocking of the door and disable unlocking of the steering wheel, starting of the engine, or unlocking of the shift lever if the perspiration amount of the driver exceeds a thresdhold value.

11. A system for monitoring a physical condition of a driver for a vehicle including an engine, a door, a shift lever, and a steering wheel, the system comprising:

a portable device carried by the driver, the portable device including a detection unit, for detecting biological information comprising at least one of perspiration amount and body temperature and serving as an index representing the physical condition of the driver when contacting the driver, a first electrode that contacts the driver, and a transmitter unit connected to the first electrode for transmitting a transmission signal including the biological information comprising at least one of perspiration amount and body temperature and detected by the detection unit via the first electrode; and a monitoring device installed in the vehicle, the monitoring device including an operation unit, operated by the driver and having a second electrode that contacts the driver, a receiver unit, connected to the second electrode, for receiving the transmission signal from the portable device via the second electrode, a control unit for receiving the transmission signal from the receiver unit and determining the physical condition of the driver based on the biological information comprising at least one of perspiration amount and body temperature and included in the transmission signal, and a notification unit for providing notification of the physical condition determined by the control unit, wherein the control unit enables the unlocking of the door and disable unlocking of the steering wheel, starting of the engine, or unlocking of the shift lever if the perspiration amount of the driver exceeds a threshold value.

12. The system as claimed in claim 11, wherein the control unit includes a recording medium for storing a predetermined threshold value and determines the physical condition of the driver based on whether or not a numerical value relating to the biological information comprising at least one of perspiration amount and body temperature exceeds the predetermined threshold value.

13. A portable device carried by a driver for a vehicle including an engine, a door, a shift lever, and a steering wheel, the portable device comprising:

a detection unit for detecting biological information comprising at least one of perspiration amount and body temperature and serving as an index representing a physical condition of the driver;

a transmitter unit for transmitting a transmission signal including the biological information comprising at least one of perspiration amount and body temperature and detected by the detection unit to the vehicle;

a receiver unit, connected to the second electrode, for receiving the transmission signal from the transmitter unit;

a control unit for receiving the transmission signal from the receiver unit and determining the physical condition of the driver based on the biological information comprising at least one of perspiration amount and body temperature and included in the transmission signal, wherein the control unit enables the unlocking of the door and disable unlocking of the steering wheel, starting of the engine, or unlocking of the shift lever if the perspiration amount of the driver exceeds a threshold value.

14. A method for monitoring a physical condition of a driver for a vehicle including an engine, a door, a shift lever, and a steering wheel, wherein the driver carries a portable device including a detection unit for acquiring biological information of the driver, the biological information comprising at least one of perspiration amount and body temperature, and the vehicle includes a monitoring device; the method comprising:

acquiring the biological information comprising at least one of perspiration amount and body temperature with the detection unit of the portable device;

transmitting a transmission signal including the biological information comprising at least one of perspiration amount and body temperature from the portable device to the monitoring device;

notifying the driver of his or her physical condition with the monitoring device based on the biological information comprising at least one of perspiration amount and body temperature and included in the transmission signal;

determining the physical condition of the driver based on the biological information comprising at least one of perspiration amount and body temperature and included in the transmission signal; and enabling the unlocking of the door and disabling unlocking of the steering wheel, starting of the engine, or unlocking of the shift lever if the perspiration amount of the driver exceeds a threshold value.

15. The method as claimed in claim 14, further comprising:

determining whether or not a numerical value relating to the biological information comprising at least one of perspiration amount and body temperature exceeds a predetermined threshold value, said notifying the driver of his or her physical condition includes notifying the driver of his or her physical condition based on the determination result of the numerical value.

16. The method as claimed in claim 14, wherein the portable device includes a first electrode that contacts the driver, and the monitoring device includes a second electrode that contacts the driver, and said transmitting a transmission signal including biological information comprising at least one of perspiration amount and body temperature includes transmitting the transmission signal including the biological information comprising at least one of perspiration amount and body temperature via the first electrode, the driver, and the second electrode.

17. The method as claimed in claim 14, wherein the vehicle has an engine and a vehicle ID code, and said transmitting a transmission signal including biological information comprising at least one of perspiration amount and body temperature includes transmitting the transmission signal including the biological information comprising at least one of perspiration amount and body temperature and a portable device ID code, the method further comprising:

enabling starting of the vehicle engine when the portable device ID code corresponds to the vehicle ID code and the physical condition of the driver is satisfactory.

18. The method as claimed in claim 14, wherein said acquiring the biological information comprising at least one of perspiration amount and body temperature includes acquiring the biological information comprising heartbeat or blood pressure and at least one of perspiration amount and body temperature.

* * * * *